United States Patent [19]

Kolb

[11] 4,000,382

[45] Dec. 28, 1976

[54] ADJUSTABLE MECHANISM FOR CONTROL DEVICES

[75] Inventor: Edgar Christian Kolb, Freeport, Ill.

[73] Assignee: Honeywell Inc., Minneapolis, Minn.

[22] Filed: Feb. 12, 1973

[21] Appl. No.: 331,497

[52] U.S. Cl. ..... 200/4; 200/153 L

[51] Int. Cl.[2] ..... H01H 19/14

[58] Field of Search ..... 200/172 A, 4, 153 L

[56] References Cited

UNITED STATES PATENTS

| | | | |
|---|---|---|---|
| 3,040,142 | 6/1962 | Dietrich et al. | 200/167 A X |
| 3,150,240 | 9/1964 | Voss | 200/8 A |
| 3,284,585 | 11/1966 | Hall | 200/4 X |
| 3,539,736 | 11/1970 | Naimer | 200/4 |

FOREIGN PATENTS OR APPLICATIONS

| | | | |
|---|---|---|---|
| 1,165,459 | 10/1969 | United Kingdom | 200/172 A |

*Primary Examiner*—Gerald P. Tolin
*Attorney, Agent, or Firm*—Philip J. Zrimsek

[57] ABSTRACT

An actuating mechanism for a manual selector-push electrical multiswitch, for example, having an actuating member including a plurality of actuating portions which can be rotatably positioned with respect to the switches to select a predetermined control pattern and reciprocally moved to actuate and deactuate the switches to bring the control pattern about, where the actuating portions can be selectively removed to provide further patterns.

3 Claims, 6 Drawing Figures

ADJUSTABLE MECHANISM FOR CONTROL DEVICES

The present invention is directed to an actuating mechanism for use with a plurality of mechanically operable control devices. More specifically, my improvement is concerned with such a mechanism which includes provisions so as to selectively allow for a change in the control pattern provided by actuation and deactuation of the control devices upon an excursion through the range of movement of the actuating mechanism. In further detail, the advance I have made is applicable to selector-push electrical switches whereby the control pattern can be changed by varying the number and arrangements of the actuating portions of the actuating mechanism.

In selector-push switches, a continuing problem is that posed by the great number of control patterns which are required by users of such devices. Conventionally, this demand has been met by providing a unique control pattern producing driver member for each control pattern the user demands. Not only is it expensive initially to provide engineering and tooling to bring each unique driver member into being, it is also expensive to maintain adequate inventories to satisfy the users' requirements in an acceptable time frame.

My contribution bypasses the problems just stated by utilizing a multicontrol pattern producing driver member in place of the unique driver member known in the prior art. Thus, my driver member includes a plurality of actuating portions so located that when incorporated in the selector-push switch it brings about a predetermined control pattern upon actuation and deactuation of the control devices during the cycle of movement of the selector-push button. By selectively removing certain of the actuating portions, various patterns are possible. As will become more evident below, I provide actuating portions which are frangible from the driver member. This expedient allows for a great variety of control patterns in a selector-push switch without the need for either the investment in unique driver members or in inventory to satisfy the user.

Therefore, it is an object of this invention to provide an actuating mechanism for a plurality of mechanically operable control devices which mechanism includes actuating portions which can be selectively varied in number and arrangement to allow for various predetermined control patterns of the control devices to be brought about upon actuation and deactuation of the control devices.

It is a further object of this invention to provide an actuating mechanism as above set forth whereby the actuating portions are varied in number and arrangement by removing certain of them from the actuating mechanism.

These and other objects will become apparent from a reading of the following specification and appended claims taken in conjunction with the drawing wherein:

Figure 1:
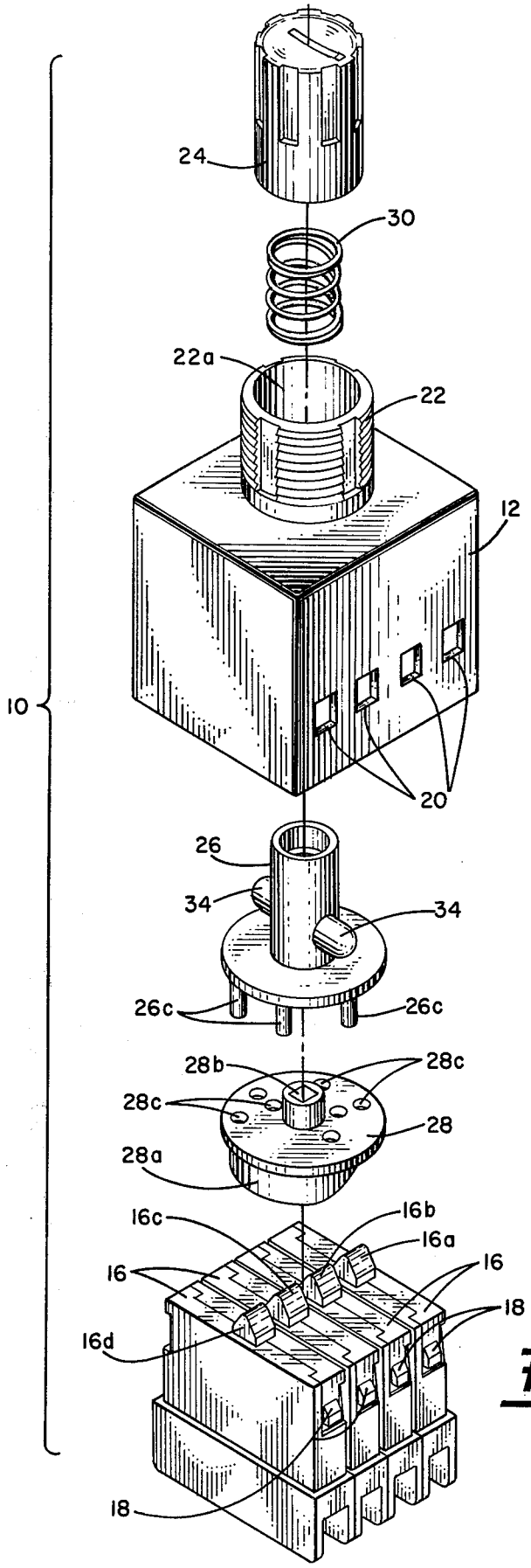
FIG. 1 is a perspective explosion view of a selector-push electrical switch incorporating the invention.
Figure 2:
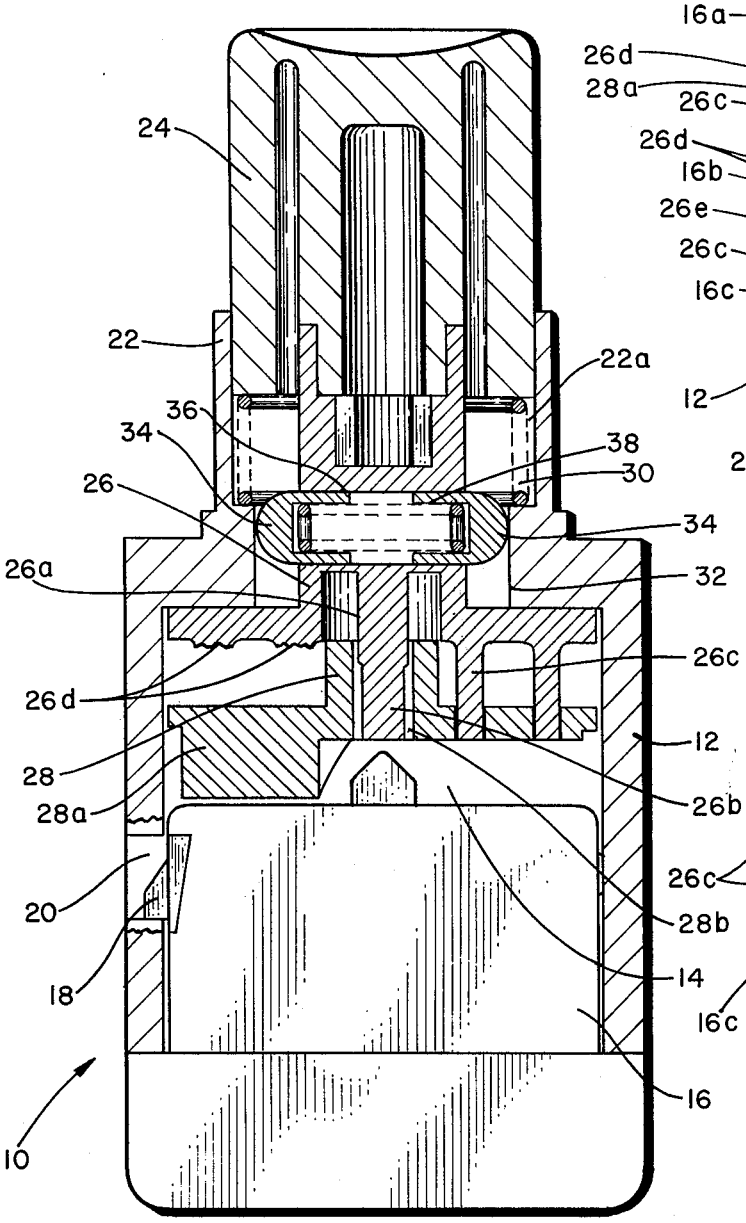
FIG. 2 is a vertical cross sectional view on a larger scale of the assembled selector-push switch of FIG. 1.

Referring now to FIGS. 1 and 2, a manual selector-push electrical switch 10 is there shown to include a support member or housing 12 having a lower cavity 14 in which a plurality of mechanically operable control devices or electrical switches 16 are arranged to be secured in place in side-by-side association by means of resilient tabs 18 provided at each end of each switch that are snap fastened into appropriate openings 20 located in the housing 12. The housing 12 further includes a threaded cylindrical bushing 22 to allow for panel mounting as is well-known in the art.

An actuating mechanism is assembled to and partially within the housing 12 so as to allow for actuation and deactuation of the switches 16. The actuating mechanism includes a selector pushbutton 24, a driver member 26 and a cam member 28, all of which are preferably formed of thermoplastic material.

The driver member 26 is located within the cavity 14 of the housing 12 prior to the switches 16 being disposed therein and is secured by means of ultrasonic welding to the selector pushbutton 24 which is located within opening 22*a*of the bushing 22. A compression coil spring 30 is disposed in the opening 22*a* of the bushing 22 and is arranged so as to bias the selector pushbutton 24 outwardly from the housing 12. A detent arrangement to maintain the selector pushbutton 24 in predetermined rotative positions may be provided and may be of the general type comprised of formed surfaces, not shown, located in bore 32 of the housing 12 for cooperation with plungers 34 which are located in opening 36 of the driver member 26 and which are arranged to be outwardly biased by means of compression coil spring 38. The assembled selector pushbutton 24 and driver member 26 is thus arranged for maintained rotary movement and momentary reciprocal movement as will be further expanded upon below.

The cam member 28 which includes depending cam portion 28*a*is also located within the cavity 14 of the housing 12 prior to the switches 16 being disposed within the cavity. Further, the cam member 28 is located so as to be contiguous with the driver member 26 and is keyed thereto by means, referring momentarily also to FIG. 3, of the upper square portion 26*a* of shaft 26*b* of the driver member being disposed in a square through opening 28*b* of the cam member so as to allow for co-axial, co-extensive rotary movement of the cam member with the driver member. The cam member 28 is retained in place by positioning means, not shown, so as to preclude reciprocal movement.

The driver member 26 includes a plurality of integral, discrete actuating portions 26*c* depending therefrom which are arranged to be slidably disposed through openings 28*c* located in the cam member 28 so as to allow for actuation of the switches 16 as will be further explained below. The driver member 26 and actuating portions 26*c* are formed as a unitary part although the actuating portions are manually frangible therefrom. Thus, referring to FIG. 3, a driver member 26 is shown with a full complement of actuating portions 26*c*. However, to accommodate the cam member 28 as shown in FIG. 2, some of the actuating portions are shown to have been removed as at 26*d*. The actuating portions 26*c* not required are preferably removed prior to locating the driver member 26 in the housing 12 although it is possible to disassemble the switches 16 and the cam member 28 to allow access to the actuating portions 26*c* and remove those necessary to provide the desired mode of actuation and deactuation.

Before proceeding further, it should be noted that the cam member 28 is not essential to the invention but it does enhance its usefulness and it does expand the range of predetermined patterns available, all of which will be evident from the following.

The operation of the selector-push switch 10 will now be described in conjunction with FIGS. 4, 5 and 6 although reference will also be made to some of the elements previously referred to which are not shown in these Figures.

Figure 4:
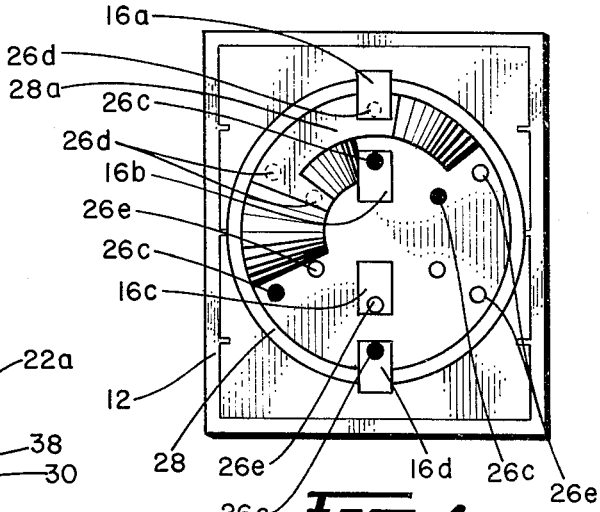
FIG. 4 is a view on a reduced scale taken along line 4—4 of FIG. 2 showing the elements in a first position.

In FIG. 4, the housing 12 is shown to encompass the cam member 28 which is located in a first maintained rotative position. The cam portion 28*a* of the cam member 28 it will be noted includes a larger outer actuating segment and a smaller inner actuating segment. The switches 16 respectively include plungers 16*a*, 16*b*, 16*c* and 16*d*. It will be appreciated that the plungers 16*a* and 16*d* are operable by the outer segment of the cam portion 28*a* of the cam member 28 and the plungers 16*b* and 16*c* are operable by the inner segment.

Figure 3:
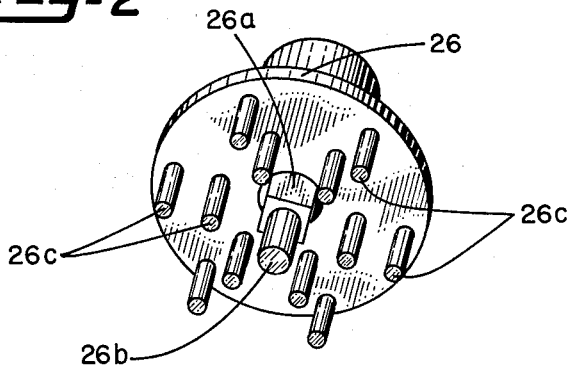
FIG. 3 is a perspective view of an element incorporated in the invention.

The driving member 26 when originally fabricated included twelve actuating portions 26*c* as is more clearly shown in FIG. 3. However, to accommodate the cam member 28, three of these have been removed as at 26*d*. Further, five have been removed as at 26*e* to provide the desired control pattern brought about by the actuation and deactuation of the switches 16. The remaining actuating portions 26*c* in FIGS. 4, 5 and 6 are shown in black for emphasis.

As shown in FIG. 4 with the selector-push switch 10 in the first rotative position, the outer segment of the cam portion 28*a* of the cam member 28 is engaged with plunger 16*a* so as to bring about and maintain actuation of the associated switch 16. Since the inner and outer segments do not engage any other plunger, the remaining switches 16 are in the deactuated condition. However, upon inward movement of the assembled selector pushbutton 24 and driver member 26, the actuating portions 26*c* overlying the plungers 16*b* and 16*d* move downwardly to cause actuation of the associated switches 16. Since no cam portion or actuating portion overlies plunge 16*c* with the selector-push switch 10 in this condition, the associated switch 16 is not and can not be actuated in the first rotative position. Of course, upon outward movement of the assembled selector pushbutton 24 and driver member 26, switches which are actuated by the actuating portions 26*c* become deactuated.

Figure 5:
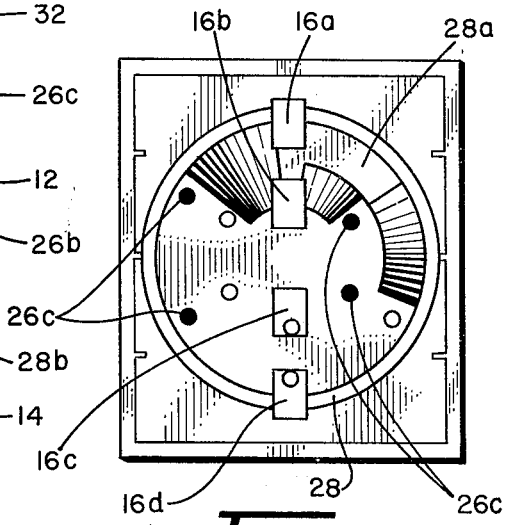
FIG. 5 is a view comparable to FIG. 4 with the elements in a second position.

Rotary movememt of the assembled selector pushbutton 24 and driver member 26 in a clockwise direction, as viewed in FIG. 5, to the second rotative position results in plunger 16*a* to continue to be engaged by the outer segment of the cam portion 28*a* of the cam member 28 so as to maintain actuation of the associated switch 16. Further, the inner segment of the cam portion 28*a* of the cam member 28 engages plunger 16*b* to bring about actuation of the switch 16 associated therewith. However, inward movement of the assembled selector pushbutton 24 and driver member 26 has no effect insofar as plungers 16*c* and 16*d* are concerned since no actuating portions 26*c* overlie these plungers in the second rotative position.

Figure 6:
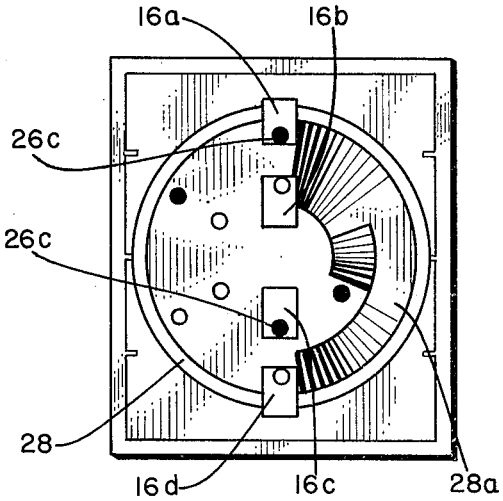
FIG. 6 is a view comparable to FIG. 4 with the elements in a third position.

Upon further rotary movement in a clockwise direction, as viewed in FIG. 6, of the assembled selector pushbutton 24 and driver member 26 to the third rotative position, the inner and outer segments of the cam portion 28*a* of the cam member 28 disengage from the plunger 16*a* and 16*b*, respectively, allowing deactuation of the associated switches 16 to take place. Further, the segments of the cam portion 28*a* do not engage the other plungers 16*c* and 16*d*, and consequently in the third rotative position, the cam member 28 is of no effect. Inward movement of the assembled selector pushbutton 24 and driver member 26 gives rise to engagement of the actuating portions 26*c* which overlie plungers 16*a* and 16*c* and actuation of the switches 16 associated therewith.

It will be understood that the selector-push switch 10 can be made to have further rotative positions so as to be freely movable in a clockwise or counterclockwise direction or be limited in rotative positions requiring a reversal in movement when an extreme position is attained, all as may be required by the application.

The preferred embodiment gives rise in the three rotative positions described to the following control pattern provided by the rotative (selector) and reciprocal (push) movements where "X" switch actuation and "O" indicates switch deactuation.

| | Rotative Position | | | | | |
|---|---|---|---|---|---|---|
| | FIG. 4 | | FIG. 5 | | FIG. 6 | |
| "Switch" | Selector | Push | Selector | Push | Selector | Push |
| 16a | X | X | X | X | O | X |
| 16b | O | X | X | X | O | O |
| 16c | O | O | O | O | O | X |
| 16d | O | X | O | O | O | O |

To change the control pattern just described can quite easily be brought about by varying the forms of the driver member 26 and/or the cam member 28 as has been indicated previously. Further, of basic importance, the form of the driver member 26 can be modified by merely removing certain of the actuating portions 26*c*. It will be appreciated that by selectively choosing the location of the actuating portions 26*c*, a large number of control patterns are possible. And of course, the control patterns possible can be further expanded by having various forms of cam members 28 available.

Other forms of my invention are possible. For example, instead of frangible actuating portions being utilized, actuating portions which snap into the driver member could be utilized. In other words, instead of determining the arrangement by removal of the actuating portions from the driver member, the same could be accomplished by the snap insertion of actuating portions into the driver member. Therefore, while I have disclosed a preferred embodiment, the scope of my invention should be determined from the following claims:

I claim:

1. An actuating mechanism for a plurality of associated, mechanically operable control device comprising: a support member; and a manual selector push type actuating means supported by and arranged for rotary and reciprocal movement with respect to said support member; said actuating means including a driving member movable therewith and disposed over the control devices; said driving member including a plurality of integral discrete actuating portions each depending therefrom, extending toward the control devices and so located as to provide predetermined control patterns of actuation and deactuation of the control devices upon initial rotary and subsequent reciprocal movement of said actuating means; the discrete actuating portions of said driving member being manually frangible therefrom to selectively allow for different numbers and different arrangements of said discrete actuating portions to provide further predetermined control patterns; said actuating means also including a cam member depending therefrom and extending toward the control devices to cause actuation and deactuation thereof upon rotary movement of said actuating means to thereby provide still further predetermined control patterns.

2. The arrangement of claim 1 wherein said driving members and said cam member are contiguous and are arranged for co-axial and co-extensive rotary movement; wherein said cam member is disposed between said driving member and the control devices and wherein said cam member includes openings to accommodate sliding passage therethrough of said actuating portions so as to allow for the actuation and deactuation thereby of the control devices.

3. The arrangement of claim 2 wherein said support is a panel mounted housing arranged to support the control devices in side-by-side relationship and said actuating means is a selector pushbutton.

* * * * *